US006823543B2

(12) United States Patent
Diak/Ghanem

(10) Patent No.: US 6,823,543 B2
(45) Date of Patent: Nov. 30, 2004

(54) QUICK CHANGE BED SHEET SET WITH ATTACHABLE ACCESSORIES

(75) Inventor: Darlene Diak/Ghanem, Deerfield Beach, FL (US)

(73) Assignee: Worry Free Inventions, Inc., Deerfield Beach, FL (US)

( * ) Notice: Subject to any disclaimer, the term of this patent is extended or adjusted under 35 U.S.C. 154(b) by 0 days.

(21) Appl. No.: 10/678,829

(22) Filed: Oct. 3, 2003

(65) Prior Publication Data

US 2004/0064889 A1 Apr. 8, 2004

Related U.S. Application Data

(63) Continuation-in-part of application No. 09/976,797, filed on Oct. 12, 2001, now Pat. No. 6,651,278.

(51) Int. Cl.[7] ..... A47G 9/04; A47C 21/08; A47D 15/00

(52) U.S. Cl. ..... 5/496; 5/425; 5/655; 5/923; 5/946

(58) Field of Search ..... 5/482, 486, 488, 5/496–500, 502, 731–733, 737, 738, 424, 425, 427, 93.1, 632, 655, 658, 663, 922, 923, 946

(56) References Cited

U.S. PATENT DOCUMENTS

| | | | | | |
|---|---|---|---|---|---|
| 2,400,731 | A | * | 5/1946 | Armstrong | 5/500 |
| 3,027,573 | A | * | 4/1962 | Bell, Jr. | 5/738 |
| 3,321,779 | A | * | 5/1967 | Kaufman et al. | 5/93.1 |
| 3,619,824 | A | * | 11/1971 | Doyle | 5/143 |
| 3,877,090 | A | * | 4/1975 | Schutz | 5/93.1 |
| 4,383,713 | A | * | 5/1983 | Roston | 297/228.12 |
| 4,890,346 | A | * | 1/1990 | Rist | 5/656 |
| 5,010,611 | A | * | 4/1991 | Mallett | 5/497 |
| 5,439,008 | A | * | 8/1995 | Bowman | 128/875 |
| 5,822,817 | A | * | 10/1998 | Carew et al. | 5/732 |
| 5,937,465 | A | * | 8/1999 | Carew et al. | 5/732 |
| 6,026,525 | A | * | 2/2000 | Davis | 5/99.1 |
| 6,651,278 | B2 | * | 11/2003 | Diak/Ghanem | 5/496 |
| 2003/0070232 | A1 | * | 4/2003 | Diak/Ghanem | 5/496 |
| 2004/0064889 | A1 | * | 4/2004 | Diak/Ghanem | 5/482 |

* cited by examiner

*Primary Examiner*—Robert G. Santos
(74) *Attorney, Agent, or Firm*—Robert M. Downey, PA

(57) ABSTRACT

A set of bed sheets includes a lower sheet sized and configured to cover the bottom portion of a mattress and an upper sheet sized and configured to cover the top portion of the mattress. First and second separable fasteners about the respective continuous edges of the lower and upper sheets are removably attachable to secure the upper sheet to the lower sheet in a manner which encloses the mattress. The upper sheet includes a top surface which is formed of a material to define a third separable fastener. A collection of accessories include a crib rail bumper, a head support wedge, body position rolls, an insulated baby bottle/cup holder and a liquid impervious drool pad. Each of the accessories is provided with a fourth separable fastener adapted for releasable attachment to the third separable fastener on the top surface of the upper sheet.

15 Claims, 3 Drawing Sheets

QUICK CHANGE BED SHEET SET WITH ATTACHABLE ACCESSORIES

This application is a continuation-in-part of patent application Ser. No. 09/976,797 filed on Oct. 12, 2001, now U.S. Pat. No. 6,651,278 the contents of which are incorporated herein by reference.

BACKGROUND OF THE INVENTION

1. Field of the Invention

This invention relates to bed sheets that are adapted to facilitate ease of changing and replacing the sheets on a mattress and, more particularly, to a bed sheet set having an upper sheet portion and lower sheet portion, which, in conjunction, enclose the mattress and, further, wherein a selection of accessories are removably attachable to the top surface of the upper sheet.

2. Discussion of the Related Art

When covering a mattress with a sheet for sleeping purposes, it is generally desired to provide a tight, neat and wrinkle-fee fit. Fitted sheets for this purpose are well know in the art. Fitted mattress sheets are designed to provide a quick and easy means for changing bed linen and typically include an elastic material around the corner edges to allow the corner edges to contract on the underside of the mattress in a manner which secures the fitted sheet in place. When properly secured to the mattress, the top surface of the fitted sheet is pulled tight and flat on the top sleeping side of the mattress. When it is necessary to change and wash the sheets, the fitted sheet is fairly easy to remove from the mattress by pulling up on the corners. Replacing the fitted sheet, however, is known to be problematic, especially if the sheets shrink after washing and drying. It is often difficult to stretch fitted sheets over the corners of the mattress in a manner which properly secures the elastic corner edges under the mattress. And, even if the fitted sheet is properly secured to the mattress, the corners are sometimes dislodged by the forces of body movement when sleeping.

The problems associated with fitted mattress sheets, as described above, are of particular concern in the field of baby linen for crib mattresses. Specifically, the need to tuck the elastic edge corners of the fitted sheet around the underside of the mattress requires lifting the crib mattress out from the crib each time the linens are changed. More importantly, fitted sheets can be easily dislodged from the mattress while an infant is in a crib. Oftentimes, the person changing the crib sheets fails to properly secure the elastic corners of the sheet under the mattress, particularly if the fitted sheet shrinks from washing and does not fit easily over the mattress corners. And, even when properly secured to the mattress, fitted crib sheets can be pulled loose by an infant. This is particularly worrisome due to the studies that have shown that many cases of Sudden Infant Death Syndrome (SIDS) are a result of smothering or suffocation due to loose linen, blankets and/or pillows in a crib. For example, if the mattress sheet comes loose, there is a dangerous possibility of an infant becoming entangled or wrapped in the sheet when tossing and turning in the crib, which could possibly lead to suffocation and death.

Accordingly, in view of the foregoing problems associated with mattress sheets, and particularly crib mattress sheets, there remains an urgent need for a bed sheet arrangement which provides for quick and easy changing of bed linen, while also providing a tight, neat, wrinkle-free and secure fit of the sheets to the mattress. There is a further need in the art for a bed sheet set which remains fitted and secured to the mattress during use and which provides for selective use of any of a number of different accessory devices which are adapted for removable attachment to the top sheet.

SUMMARY OF THE INVENTION

The present invention is directed to a set of bed sheets including a lower sheet sized and configured to cover the bottom portion of a mattress and upper sheet sized and configured to cover the top portion of the mattress. First and second separable fasteners about the respective continuous edges of the lower and upper sheets are removably attachable to secure the upper sheet to the lower sheet in a manner which encloses the mattress. The upper sheet includes a top surface which is formed of a material to define a third separable fastener. A collection of accessories are provided, including a crib rail bumper, a head support wedge, body position rolls and a liquid impervious drool pad. Each of the accessories includes a fourth separable fastener adapted for releasable attachment to the third separable fastener on the top surface of the upper sheet.

OBJECTS AND ADVANTAGES OF THE INVENTION

With the foregoing in mind, it is a primary object of the present invention to provide a set of bed sheets which are structured and disposed to permit quick and easy changing of the bed linen without moving or disturbing the mattress.

It is a further object of the present invention to provide a set of bed sheets which includes a lower sheet and an upper sheet which, in conjunction, are structured and disposed to enclose the mattress, and further including a selection of accessories for removable attachment to the top sheet.

It is still a further object of the present invention to provide a set of bed sheets which is particularly suited for use on a crib mattress and wherein the set of bed sheets includes an upper sheet and a lower sheet, which, in conjunction, enclose the crib mattress and remain secured thereto during use, without being dislodged, and further wherein the set of bed sheets includes a selection of accessories for selective positioning and removable attachment to the upper sheet.

These and other objects and advantages of the present invention are more readily apparent with reference to the following detailed description taken in conjunction with the accompanying drawings.

BRIEF DESCRIPTION OF THE DRAWINGS

For a fuller understanding of the nature of the present invention, reference should be made to the following detailed description taken in conjunction with the accompanying drawings in which.

Like reference numerals refer to like part throughout the several views of the drawings.

DETAILED DESCRIPTION OF THE PREFERRED EMBODIMENT

Figure 1:
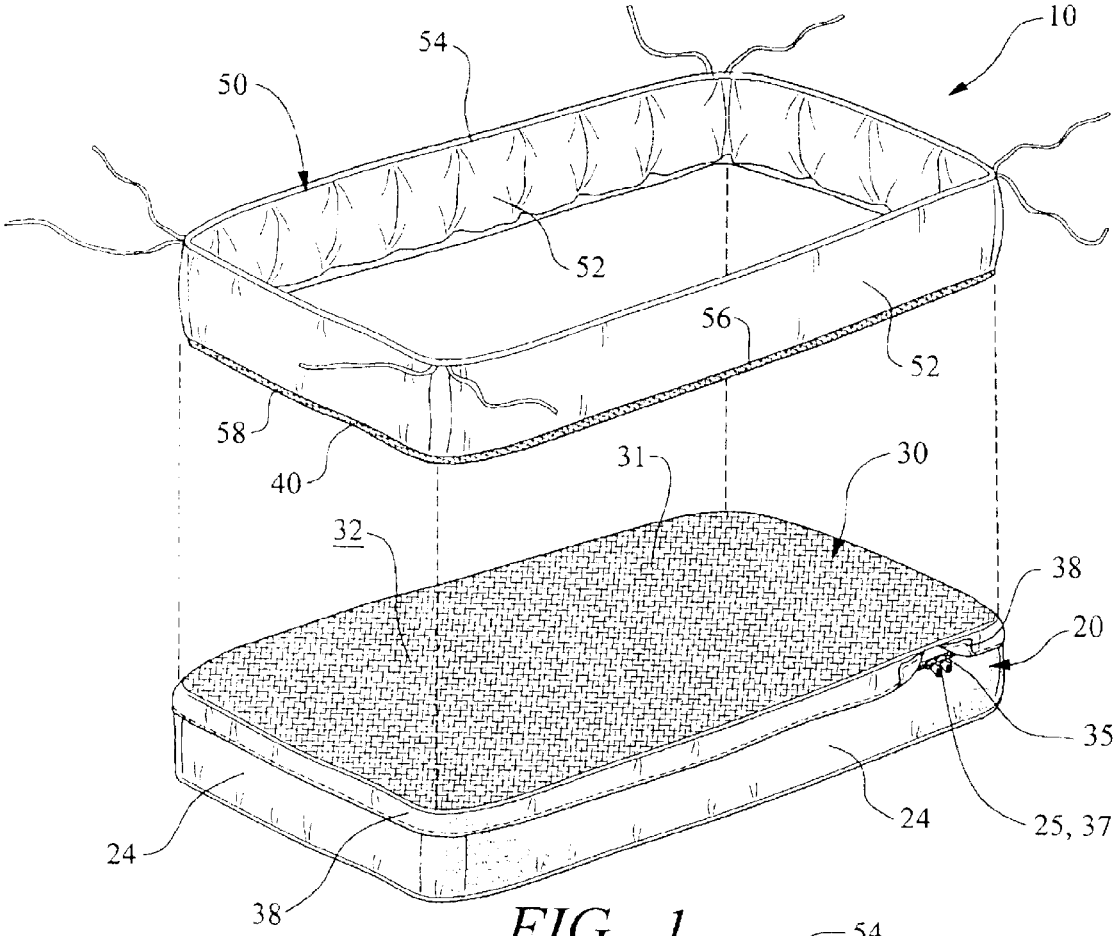
FIG. 1 is a top exploded perspective view showing the bed sheet set of the present invention secured to a mattress and a crib bumper accessory separated therefrom.

Referring to the several view of the drawings, the bed sheet set of the present invention is shown and is generally indicated as 10. The bed sheet set 10 includes a lower sheet 20 and an upper sheet 30 which, in conjunction, are structured to enclose a mattress 100. Specifically, the lower sheet includes a bottom panel 21 and upstanding side walls 24 about the periphery. The juncture between the bottom panel 21 and the side walls 24 may be of conventional construction with seamed edges to facilitate a snug, uniform fit about the bottom and sides of the mattress 100.

The upper sheet 30 is defined by a main top panel 31 which has a top outer surface 32 and a peripheral extremity 35. The top sheet is specifically sized and configured to completely overly the top sleeping surface of the mattress 100. In a preferred embodiment, the peripheral extremity 35 of the upper sheet 30 extends partially down the side walls of the mattress 100. When the upper sheet 30 and lower sheet 20 are properly fitted to the mattress 100, the peripheral zone 26 along the side walls 24 of the lower sheet meets the peripheral edge zone 36 along the peripheral extremity 35 of the upper sheet 30 about the sides of the mattress. A first releasable fastener 37 is attached to the peripheral edge zone 36 and is structured and disposed for cooperating, releasable attachment to a second releasable fastener 25 fitted about the peripheral zone 26 of the lower sheet 20. The first and second releasable fasteners 37, 25, respectively, may be of a series of cooperating fasteners, such as opposite sides of a zipper, cooperating button and button holes, male and female snaps, or hook and loop fabric such as VELCRO or releasable cohesive materials. The fasteners 37, 25 should be of materials that will withstand numerous use and laundering cycles. In a preferred embodiment, the cooperating releasable fasteners 37, 25 are defined by non-corrosive zippers which join the lower sheet 20 and upper sheet 30 about their entire correspondingly positioned peripheral edge zones to completely enclose the mattress 100 therein. A fly or flap 38 may be provided for covering the cooperating releasable fasteners 25, 36 of the lower and upper panels when the fasteners are attached. The fly 38 extends from the peripheral edge zone 36, as best seen in FIGS. 1 and 2, and is specifically structured to extend downwardly and overly the attached fasteners 37, 25, thereby concealing the fasteners from view.

A selection of accessory devices are provided for independent releasable attachment to the bed sheet set, and preferably the upper sheet 30. In a preferred embodiment, the accessory devices include a crib rail bumper 50, a head supporting wedge 60, body position roles 70, a baby bottle/sip cup insulated holder 80 and a liquid impervious drool pad 90. Each of the accessory devices are adapted for removable attachment to the top out surface 32 of the upper sheet 30. In a preferred embodiment, each of the accessory devices is provided with hook fabric 40 of a hook and loop releasable fastening system. Specifically, the hook fabric 40 is secured to the underside of each of the accessory devices and is adapted for removable attachment to the top outer surface 32 of the upper sheet 30 which is of a loop type fabric. In a preferred embodiment, the loop-type fabric forming the top outer surface 32 of the upper sheet 30 is TRICOT material. It is noted, however, that the top outer surface 32 may be of any suitable material which is comfortable for contact with the skin, and particularly an infant's skin, and which is adapted for releasable attachment to the hook fabric 40.

Figure 2:
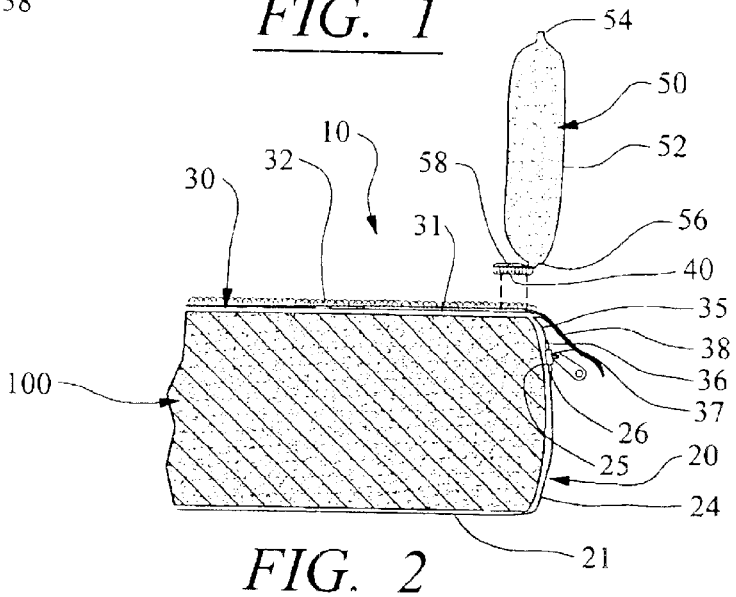
FIG. 2 is an isolated cross-sectional view illustrating attachment of the crib bumper to the top surface of the upper sheet of the bed sheet set.
Figure 3:
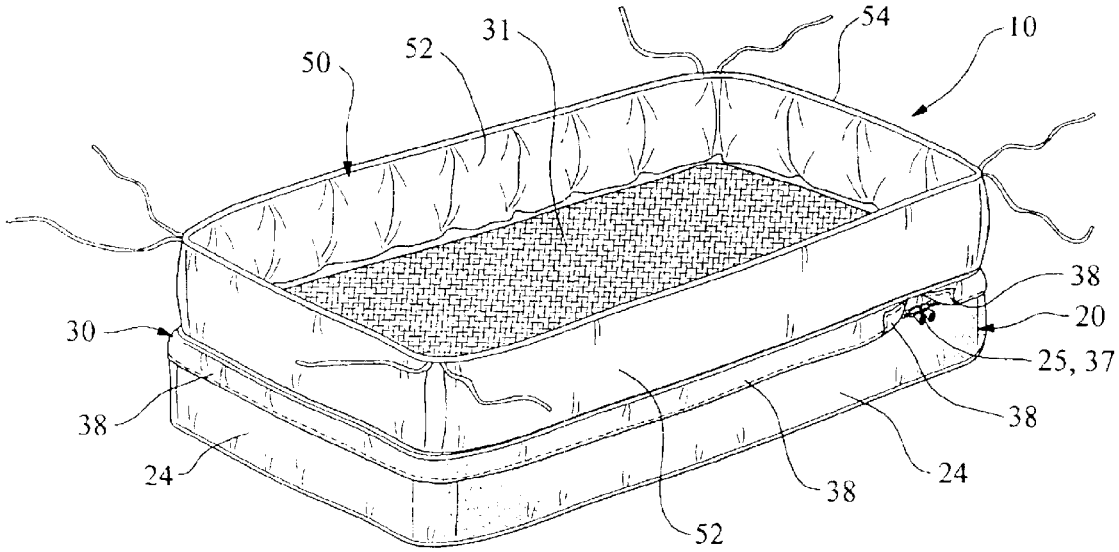
FIG. 3 is a top perspective view showing the crib bumper secured about the outer periphery of the top surface of the upper sheet of the bed sheet set.
Figure 4:
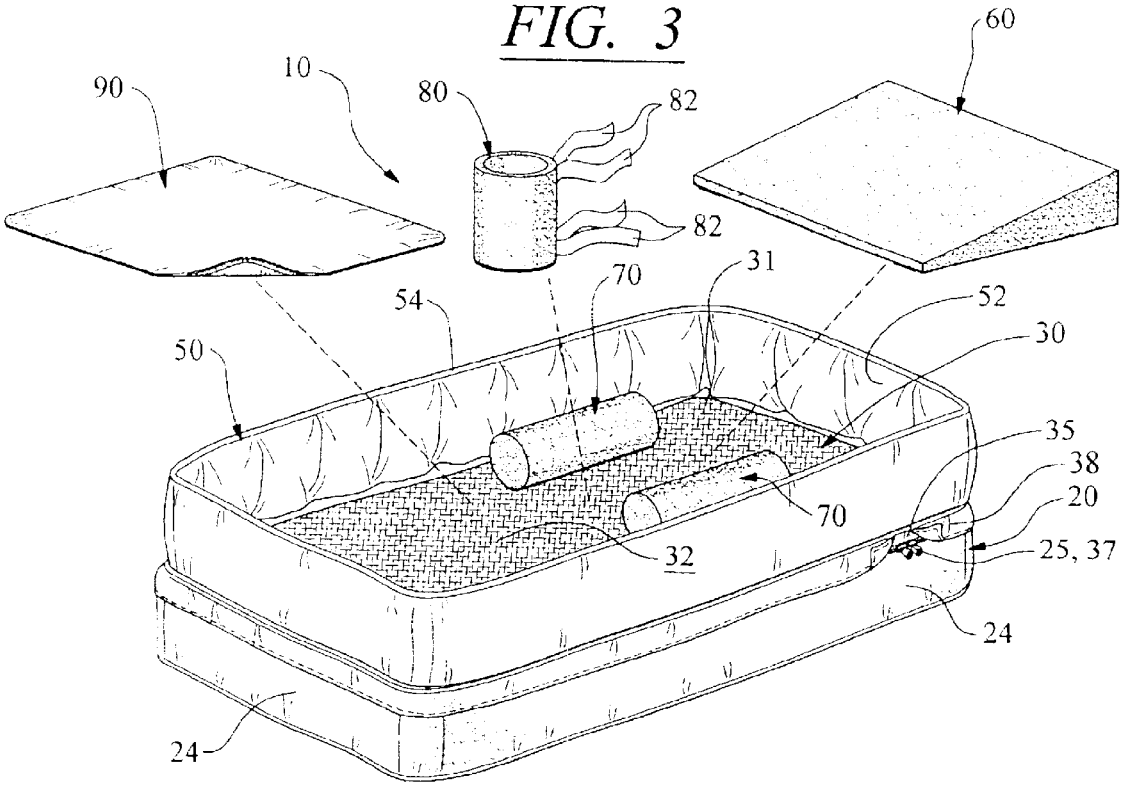
FIG. 4 is an exploded view showing the bed sheet set of the present invention secured to the mattress and an arrangement of accessories adapted for removable attachment to the top surface of the upper sheet.
Figure 5:
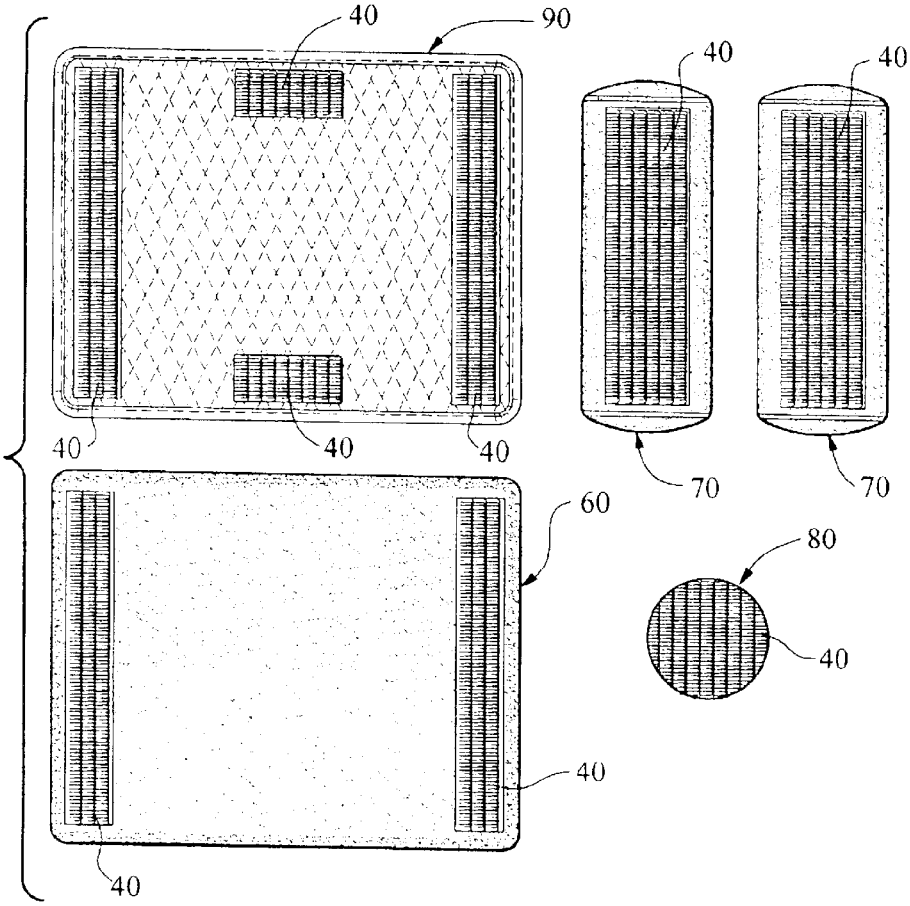
FIG. 5 is a bottom plan view showing the separable fasteners on the bottom sides of the various accessory devices of the invention.
Figure 6:
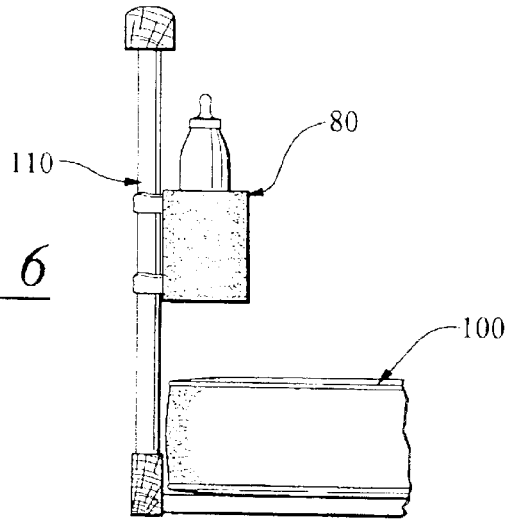
FIG. 6 is an isolated side elevational view showing a baby bottle/cup holder accessory device secured to the side railing of a crib.

Referring now to FIGS. 1–3, the crib rail bumper 50 is shown in relation to the bed sheet set 10 and includes a generally elongate padded body 52 which is structured to extend about the outer periphery of the top surface of the upper sheet forming a generally rectangular closed loop within a crib. The crib rail bumper 50 is preferably structured to include an outer fabric shell and an inner padded core. The outer shell includes a top peripheral edge 54 and a bottom peripheral edge 56. A tab or flap 58 extends from the bottom peripheral edge along the entire length of the bumper. The fourth separable fastener 40 (e.g. hook fabric) is fixed to the underside of the flap 58 and is adapted for releasable attachment to the outer top surface of the upper sheet. When secured in this manner, as shown in FIGS. 3 and 4, the crib rail bumper 50 provides a barrier between the interior of the crib and the rails of the crib. In addition to the cosmetic and bumper protection features common to any conventional crib rail bumper, the attachment of the crib rail bumper accessory 50 to the upper sheet provides an additional safety feature. Specifically, attachment of the crib rail bumper 50 to the upper sheet prevents an infant or toddler from becoming entangled in the rails of the crib between the lower end of the bumper and the mattress top. More specifically, attachment of the crib rail bumper accessory 50 to the upper sheet prevents an infant or toddler from inserting their arms, legs or head under the bumper and between the crib rails, thereby preventing potentially injurious entanglement between the rails of the crib.

Referring to FIG. 4, additional accessory devices include the head supporting wedge 60, the body position rolls 70, a baby bottle/sip cup insulated holder 80 and a liquid impervious drool pad 90. The head supporting wedge 60 is particularly useful for elevating the head and upper torso of an infant or young toddler when nursing or when the child is sick. In a preferred embodiment, the head supporting wedge 60 includes a foam inner core and a removable outer casing which is preferably formed of cotton or other like material. A liquid impervious lining may be provided under the casing to prevent beverage spills, drool and other liquid or moisture from being absorbed from the foam inner core. Similar to the head supporting wedge 60, the body position roll 70 preferably include a foam inner core and an outer casing. The body position roll 70 are particularly useful for use with infants to prevent the infant from rolling during their sleep. The insulated baby bottle/sip cup holder 80 is formed of a neoprene material or other like insulative material which is soft, thereby preventing injury to an infant in the crib. The insulative material may be covered by an outer fabric casing. In addition to attaching to the outer top surface of the upper sheet, the holder 80 is attachable to the side rails 110 of a crib. Specifically, straps 82 are provided for securing the cup holder to one of the side rails 110 on the crib. The straps 82 may be made as part of the outer casing and are secured by tying or with the use of releasable fastening means, such as hook and loop fasteners. The drool pad 90 includes an outer fabric lining and an inner waterproof panel for preventing penetration of liquids through the drool pad 90, thereby protecting the upper sheet and extending the time between laundering the sheets.

Each of the accessories, as described above, is provided with a fourth separable fastener adapted for releasable attachment to the third separable fastener on the top surface of the upper sheet. As previously described, the fourth separable fastener 40 is preferably a hook fabric which is secured to the underside of each of the accessory devices and is adapted for removable attachment to the top outer surface 32 of the upper sheet which is of a loop type fabric. Accordingly, each of the accessory devices can be selectively positioned and removably secured in place on the top surface of the upper sheet.

While the instant invention has been shown and described in accordance with preferred and practical embodiments thereof, it is recognized that departures from the instant disclosure are contemplated within the spirit and scope of the present invention which, therefore, should not be limited except as set forth in the following claims as interpreted under the Doctrine of Equivalents.

What is claimed is:

1. A set of bed sheets for covering a mattress having a bottom surface, a top surface and an upstanding periphery, said set of bed sheets comprising:

a lower sheet of a size adapted to cover the bottom surface of the mattress and including a first continuous edge extending about a periphery thereof;

a first separable fastener disposed about said continuous edge of said lower sheet;

an upper sheet of a size adapted to cover the top surface of the mattress and including a second continuous edge extending about a periphery thereof;

a second separable fastener disposed about said second continuous edge of said upper sheet;

said first and second separable fasteners adapted to be temporarily connected to attach said upper sheet to said lower sheet and to enclose the mattress, whereby said upper sheet may be removed for laundering and said lower sheet may remain on the mattress for extended use;

at least one accessory device for use in conjunction with said lower sheet and said upper sheet;

a third separable fastener on said upper sheet;

a fourth separable fastener on said at least one accessory device; and said third and fourth separable fasteners adapted to be temporarily attached to releasably secure said at least one accessory device to said upper sheet.

2. The set of bed sheets as recited in claim 1 wherein said fourth and third separable fasteners are hook and loop type fasteners, respectively.

3. The set of bed sheets as recited in claim 2 wherein said fourth separable fastener is a hook material and said third separable fastener is TRICOT material.

4. The set of bed sheets as recited in claim 3 wherein said first and second separable fasteners are selected from the group consisting of: zippers; buttons and button holes; male and female snaps; mutually cohesive materials; and hook and loop type fasteners.

5. The set of bed sheets as recited in claim 4 wherein said at least one accessory device is selected from the group consisting of: a crib rail bumper; a head support wedge; body position rolls; a baby bottle holder; a cup holder; and a liquid impervious drool pad.

6. The set of bed sheets as recited in claim 1 further comprising:

a fly extending from said second continuous edge of said upper sheet to overlay said second separable fastener of said upper sheet.

7. The set of bed sheets as recited in claim 6 wherein said fly is structured and disposed to overlay said second separable fastener and said first separable fastener when said upper sheet is attached to said lower sheet.

8. A set of bed sheets for covering a mattress having a bottom side, a top side and an upstanding periphery, said set of bed sheets comprising:

a lower sheet of a size adapted to cover the bottom side of the mattress and including a first continuous edge extending about a periphery thereof;

a first separable fastener disposed about said continuous edge of said lower sheet;

an upper sheet of a size adapted to cover the top side of the mattress and including a second continuous edge extending about a periphery thereof;

a second separable fastener disposed about said second continuous edge of said upper sheet;

said first and second separable fasteners adapted to be temporarily connected to attach said upper sheet to said lower sheet and to enclose the mattress, whereby said upper sheet may be removed for laundering and said lower sheet may remain on the mattress for extended use;

a plurality of accessory devices for use in conjunction with said upper and lower sheets;

a third separable fastener on said upper sheet;

a fourth separable fastener on each of said plurality of accessory devices; and said third and fourth separable fasteners adapted to be temporarily attached to releasably secure any select one or more of said plurality of accessory devices to said upper sheet.

9. The set of bed sheets as recited in claim 8 wherein said third and fourth separable fasteners are adapted to be temporarily attached to selectively position and releasably secure any select one or more of said plurality of accessory devices to said upper sheet.

10. The bed sheets as recited in claim 9 wherein said fourth and third separable fasteners are hook and loop type fasteners, respectively.

11. The set of bed sheets as recited in claim 10 wherein said first and second separable fasteners are selected from the group consisting of: zipper; buttons and button holes; male and female snaps; mutually cohesive material; and hook and loop type fasteners.

12. The set of bed sheets as recited in claim 11 wherein said plurality of accessory devices include: a crib rail bumper; a head support wedge; body position rolls; a baby bottle holder; a cup holder; and a liquid impervious drool pad.

13. The set of bed sheets as recited in claim 12 wherein said baby bottle holder and said cup holder are insulated.

14. The set of bed sheets as recited in claim 13 wherein said baby bottle holder and said cup holder include strap members for removable attachment of said baby bottle holder and said cup holder to a side rail of a crib.

15. The set of bed sheets as recited in claim 14 wherein said crib rail bumper includes said fourth releasable fastener about a bottom peripheral edge for releasable attachment to said upper sheet, thereby releasably attaching said crib rail bumper to said upper sheet about an entire periphery of said top side of said mattress.

* * * * *